US010035562B2

(12) United States Patent
Codda et al.

(10) Patent No.: US 10,035,562 B2
(45) Date of Patent: Jul. 31, 2018

(54) ASSEMBLY FOR CONNECTING A NON-STRUCTURAL BULKHEAD TO THE STRUCTURE OF A SHIP, AND METHOD FOR THE INSTALLATION THEREOF

(71) Applicant: CENTRO PER GLI STUDI DI TECNICA NAVALE—CETENA S.p.A., Genoa (IT)

(72) Inventors: Matteo Codda, Genoa (IT); Andrea Pullara, Genoa (IT); Gaetano De Luca, Genoa (IT)

(73) Assignee: CENTRO PER GLI STUDI DI TECNICA NAVALE—CENTENA S.P.A., Genoa (IT)

( * ) Notice: Subject to any disclaimer, the term of this patent is extended or adjusted under 35 U.S.C. 154(b) by 0 days.

(21) Appl. No.: 15/525,881

(22) PCT Filed: Nov. 11, 2015

(86) PCT No.: PCT/IB2015/058702
§ 371 (c)(1),
(2) Date: May 10, 2017

(87) PCT Pub. No.: WO2016/075628
PCT Pub. Date: May 19, 2016

(65) Prior Publication Data

US 2017/0327187 A1 Nov. 16, 2017

(30) Foreign Application Priority Data

Nov. 12, 2014 (IT) ..... MI2014A1954

(51) Int. Cl.
*B63B 3/56* (2006.01)
*B63B 3/34* (2006.01)
*B63B 43/24* (2006.01)

(52) U.S. Cl.
CPC ..... *B63B 3/34* (2013.01); *B63B 3/56* (2013.01); *B63B 43/24* (2013.01)

(58) Field of Classification Search
CPC ..... B63B 3/34; B63B 3/56; B63B 43/24
(Continued)

(56) References Cited

U.S. PATENT DOCUMENTS 787,065 A * 4/1905 White ..... F41H 5/04 109/79
2,218,688 A 10/1940 Stewart
(Continued)

FOREIGN PATENT DOCUMENTS

DE 197 07 217 A1 8/1998
WO 01/96683 A1 12/2001

OTHER PUBLICATIONS

International Search Report and Written Opinion of the International Searching Authority for corresponding International Patent Application No. PCT/IB2015/058702 dated Mar. 4, 2016, 9 pgs.

*Primary Examiner* — Stephen P Avila
(74) *Attorney, Agent, or Firm* — Merchant & Gould P.C.

(57) ABSTRACT

A floating connection assembly of a bulkhead to at least one element of constraint includes a projection integral to the element of constraint and at least one first longitudinal sealing bead. At least one projecting element protrudes from the bulkhead. The assembly has at least a second flexible seal and at least one closure plate, arranged in such a way that the bulkhead and the element of constraint are separated along an edge of the bulkhead. The one first longitudinal sealing bead is interposed between the bulkhead and the projection, on which is present at least one through hole through which passes the projecting element, integral with a respective closure plate, so that the bulkhead remains cantilevered on the protrusion, avoiding a different support, and
(Continued)

so that the projecting element is free to oscillate inside the hole.

20 Claims, 6 Drawing Sheets

(58) Field of Classification Search
USPC ..... 114/80
See application file for complete search history.

(56) References Cited

U.S. PATENT DOCUMENTS

| | | | | | |
|---|---|---|---|---|---|
| 2,362,226 | A * | 11/1944 | Weaver | B63B 3/14 | 114/116 |
| 2,585,980 | A * | 2/1952 | Vasta | B63B 3/60 | 114/78 |
| 5,014,370 | A * | 5/1991 | Stark, Sr. | E04H 4/145 | 4/496 |
| 2006/0162279 | A1 * | 7/2006 | Bergan | B32B 15/04 | 52/783.1 |
| 2011/0248119 | A1 * | 10/2011 | Stol | B63B 3/00 | 244/131 |

* cited by examiner

FIG.3
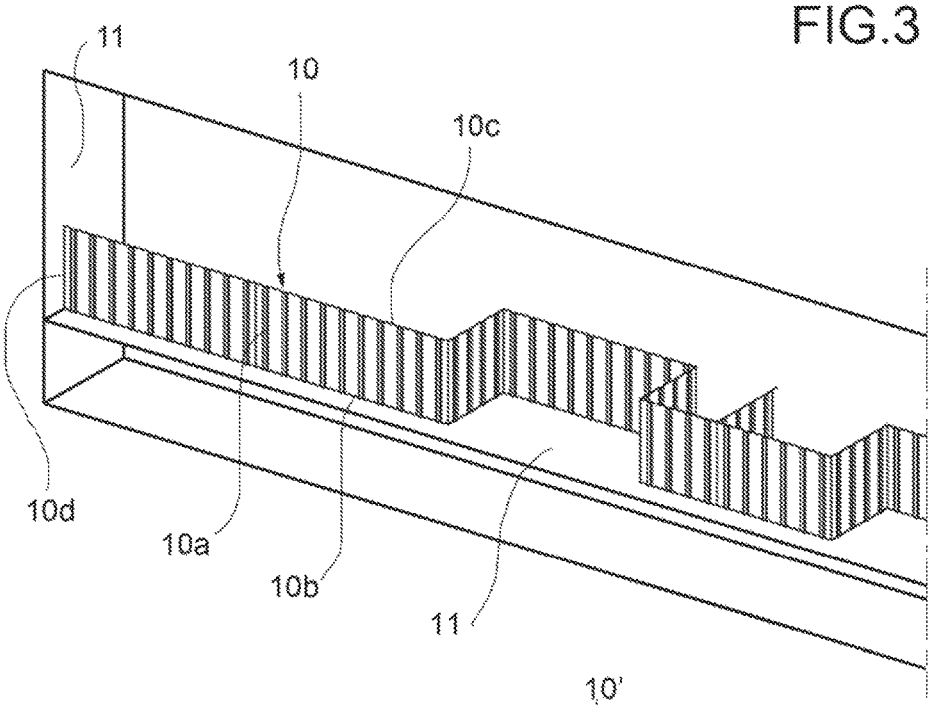
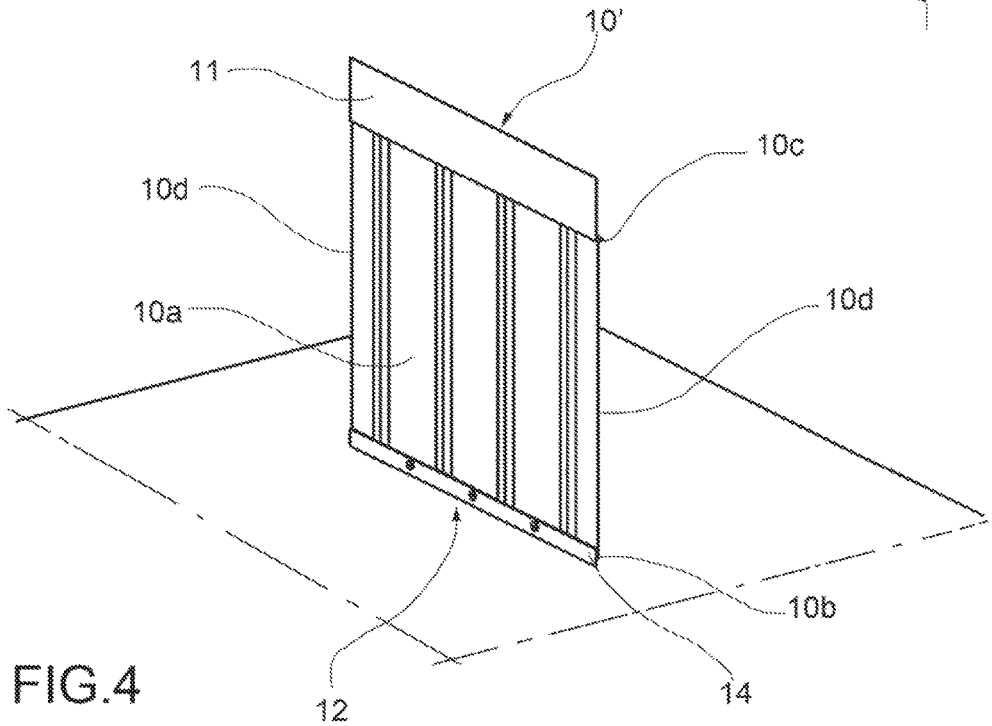
FIG.4

ASSEMBLY FOR CONNECTING A NON-STRUCTURAL BULKHEAD TO THE STRUCTURE OF A SHIP, AND METHOD FOR THE INSTALLATION THEREOF

This application is a National Stage Application of PCT/M2015/058702, filed 11 Nov. 2015, which claims benefit of Serial No. MI2014A001954, filed 12 Nov. 2014 in Italy and which applications are incorporated herein by reference. To the extent appropriate, a claim of priority is made to each of the above disclosed applications.

TECHNICAL FIELD

The present invention pertains, in general, to the field of metal carpentry; in particular, the invention relates to a connection assembly between structural and non-structural elements of a vessel.

PRIOR ART

With particular reference to the naval field, the structural bulkheads and the so-called "non-structural" partitioning bulkheads are distinguished. The difference between the two is that the former serve a supporting function, and are made of planar metal sheets associated with a framework comprising uprights and horizontal reinforcement profiles, while the latter serve no structural function, but a merely separating one.

The non-structural bulkheads, typically made in the form of planar or corrugated sheets, are lighter than the structural bulkheads, and are not considered in the design calculation of the structures, to evaluate the overall behavior of the ship, since they do not contribute to the overall resistance of the structure.

The non-structural corrugated bulkheads are able to withstand local loads only, due for example to the connection of components such as steel pipes, electrical panels, etc., in the absence of structural reinforcements such as cords, ribs, etc.

In the prior art, the corrugated bulkheads are joined to structural load-bearing elements of the ship by means of a weld junction and, having a cross section with standard geometry, they are not sized to bear the loads which are inevitably transmitted by the structures connected thereto.

During the operation of the ship, it happens in fact that the corrugated bulkheads, and in particular the longitudinal ones, exhibit substantial flexions, bulging or even considerable plastic deformations, due to the load transmitted by the settling of the load-bearing structures of the ship. In particular, the stresses transmitted by the structure of the ship may result in a peak load instability of the metal sheets which form the non-structural bulkheads, and as said may generate the collapse of the bulkheads themselves.

In order to obviate these problems, in the prior art it is preferred to make use of heavy structural bulkheads even when their use is solely to serve as partition walls, thus avoiding the bulkheads from flexing, especially when these must cover long segments. It is obvious that such a solution is widely disadvantageous, both in economic terms and in terms of the weight unnecessarily added to the structure.

SUMMARY OF THE INVENTION

It is an object of the present invention to obviate the aforementioned problems, providing a solution to manufacture non-structural bulkheads which are not subjected to substantial deformation during the operation of the ship (or, as it will be seen, in a building), while ensuring reliability and lightness of said bulkheads.

In order to achieve this result, use is made of a connection assembly of the bulkhead to the structures of the ship adjacent thereto, which may be load-bearing structures rather than other partitioning panels (as it will be much appreciated in the description below), so that between said elements there is not a rigid constraint, such as to affect the structural stability or integrity of the bulkhead.

The connection assembly suggested according to the present invention allows a flexible constraint to be provided, which allows the non-structural bulkheads to be unloaded with respect to the stresses transmitted by the structural elements of the ship.

More in detail, in the assembly according to the invention there is a separation gap between the bulkhead and the constraint element, to which it must be connected, which gap allows the structure to settle in the absence of a direct transmission of the stress from the load-bearing structure to the non-structural bulkhead. The bulkhead is thus indirectly connected to the constraint element (which preferably is a structural element of the ship) by means of the coupling between a protrusion, integral with the constraint element, and at least one element projecting from the bulkhead, free to oscillate in a hole obtained on the surface of the aforesaid protrusion.

As the possibility exists for the projecting element (for example, a cylindrical stud) to oscillate with respect to the fixed constraint, a decoupling between the bulkhead and the structure connected thereto occurs. As the rigidity of the constraint disappears, the stresses transmitted to the bulkhead from the bordering structures will not be such to affect the structural stability or integrity thereof.

BRIEF DESCRIPTION OF THE DRAWINGS

The operational and structural features of some preferred embodiments of a connection assembly according to the invention will now be described. Reference is made to the accompanying drawings, in which:

FIG. 3 is a diagrammatic view of a detail in FIG. 2;

FIG. 4 is a diagrammatic axonometric view of a portion of a bulkhead, according to an embodiment of the invention;

DETAILED DESCRIPTION

Figure 1:
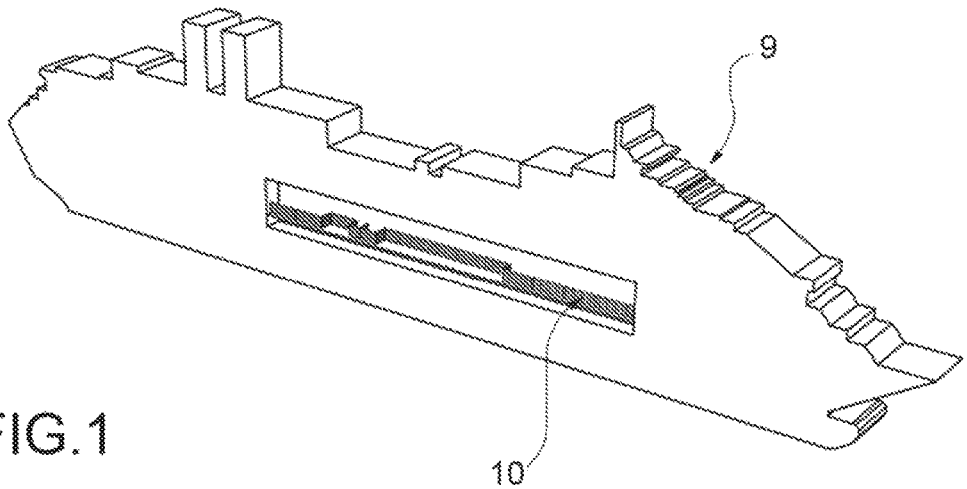
FIG. 1 is a diagrammatic axonometric view of a portion of a vessel, comprising a plurality of non-structural bulkheads therein, according to an embodiment of the invention.
Figure 2:
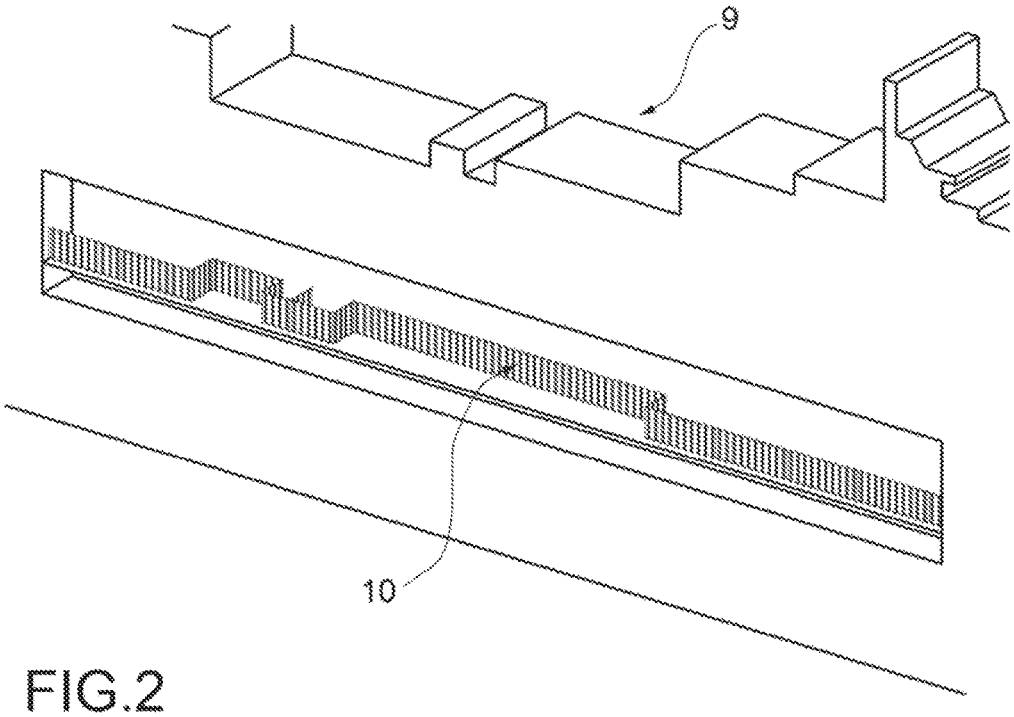
FIG. 2 is a diagrammatic view of a detail in FIG. 1.

Before explaining in detail a plurality of embodiments of the invention, it should be clear that the invention is not limited in the application thereof to the constructional details and to the configuration of the components disclosed in the following description or shown in the drawings. The invention is able to take other embodiments and to be carried out or practically made in different ways. It should also be understood that the phraseology and terminology have descriptive purposes and shall not be construed as limiting.

The case described below relates to a technical solution which is explained in detail for the case of a bulkhead of a ship, but it is understood that the same technical solution adopted to connect the bulkhead to the surrounding structure, so as to decouple it with respect to the stresses which may be transmitted thereto by the structure itself, is also adoptable in other contexts, where the same technical problem exists.

For example, in industrial or civil constructions the need to decouple the partition walls from the load-bearing structures of the building (regardless of their construction material) may arise, so that a stress, caused by a structural settling, by a seismic event, etc., is not transmitted to said partition walls, and therefore, does not compromise the integrity or the structural stability thereof.

It is emphasized, however, that a plurality of embodiments of the invention in the naval field will be described below, reiterating that other application contexts are not excluded, in which the solution suggested here will help to solve the same technical problem.

Initially referring to FIG. 1, a vessel 9 comprises a plurality of non-structural bulkheads 10, particularly suitable to separate the various interior spaces of the vessel, but without offering contributions to the structural resistance thereof.

FIG. 3 shows a possible configuration of a non-structural bulkhead 10, comprising a first face 10*a*, which is substantially vertical and optionally corrugated, said surface being delimited by a plurality of edges 10*b*, 10*c*, 10*d* in the longitudinal and vertical directions.

Bulkhead 10 is variously connected to one or more constraint elements 11, in the example shown in FIG. 3 represented by a deck of the ship (to which the bulkhead is connected along its lower edge 10*b*), and by a vertical wall (to which the bulkhead is connected along a side edge 10*d*).

Figure 5:
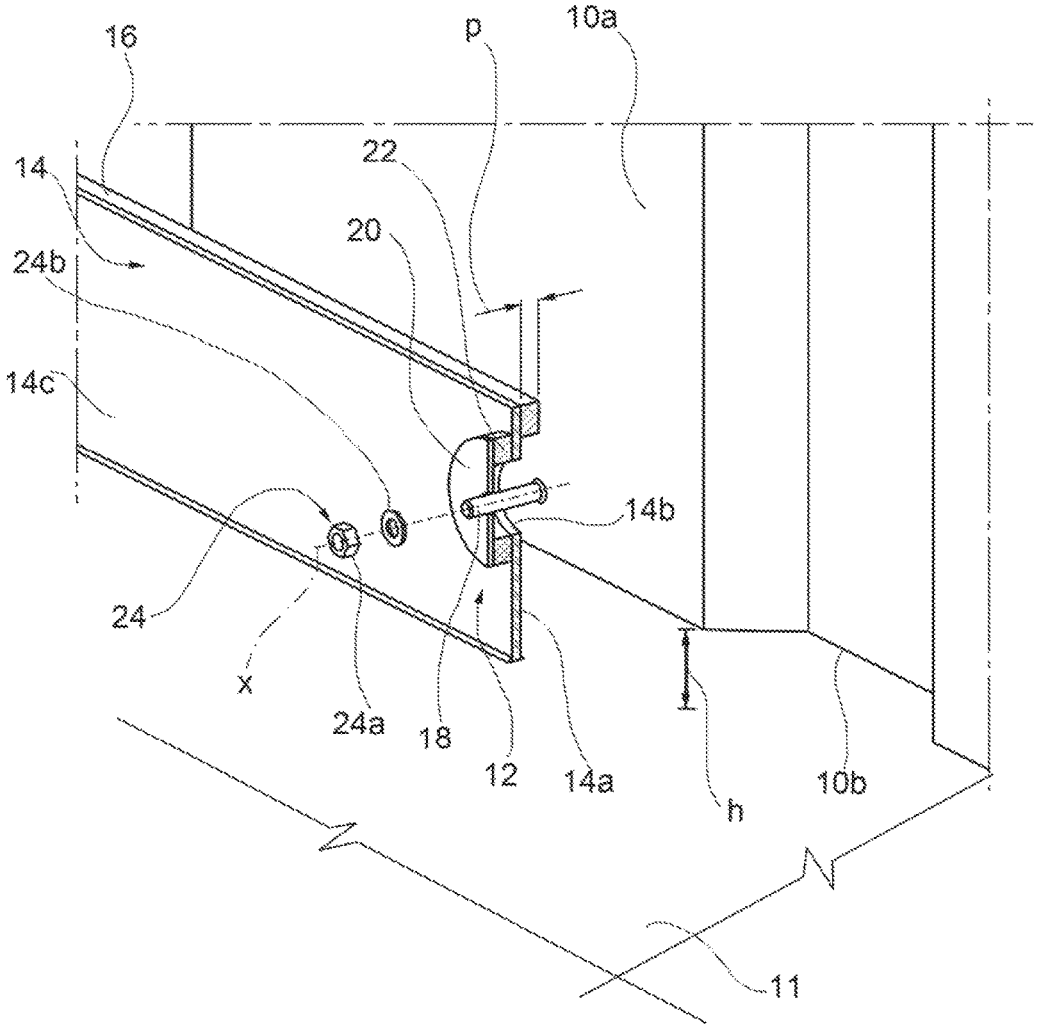
FIG. 5 is a diagrammatic perspective view of a detail of a connection assembly, according to an embodiment of the invention.

As it is necessary to decouple the bulkhead from at least one of the constraint elements adjacent thereto, FIG. 5 shows an embodiment of a floating connection assembly 12, adapted to connect bulkhead 10 to a constraint element 11, in this case represented by the deck of the ship.

The floating connection assembly 12 is conceived so as to provide the aforesaid decoupling, so that the bulkhead does not receive the stresses transmitted by the structure of the ship; for this purpose, the bulkhead 10 and the constraint element 11 are mutually separated by a separation distance h along an edge (in this case, the lower edge 10*b*) of bulkhead 10. It is assumed that the transverse thickness of bulkhead 10 is negligible with respect to the two dimensions of the first face 10*a*.

More in detail, the fastening assembly 12 comprises a protrusion 14 (seen in FIG. 5), integral with the constraint element 11 (in the example shown here, by welding).

Protrusion 14 has a second face 14*a* opposite and parallel to the first face 10*a* of bulkhead 10, and a third face 14*c* parallel to the second face 14*a*. Protrusion 14 is spaced apart from bulkhead 10 by a clearance p, along a normal direction to the second face 14*a* of protrusion 14.

According to an embodiment, at least one longitudinal sealing bead 16 is interposed between protrusion 14 and bulkhead 10, so as to be longitudinally connected to the first face 10*a* of bulkhead 10 on one side, and to the second face of protrusion 14 on the opposite side, so as to have a transverse thickness which is substantially equal to clearance p and ensure the resistance to water between protrusion 14 and bulkhead 10. The sealing bead 16 may be a first flexible seal or, alternatively, one or more beads of sealing adhesive material can be employed, for example silicone-based, even with flame-retardant properties; mono and bi-component polyurethane-based, with flame-retardant properties; based on hybrid polymers, with flame-retardant properties; or based on acrylic materials, with flame-retardant properties and in some formulations with excellent flame reaction properties.

Figure 8:
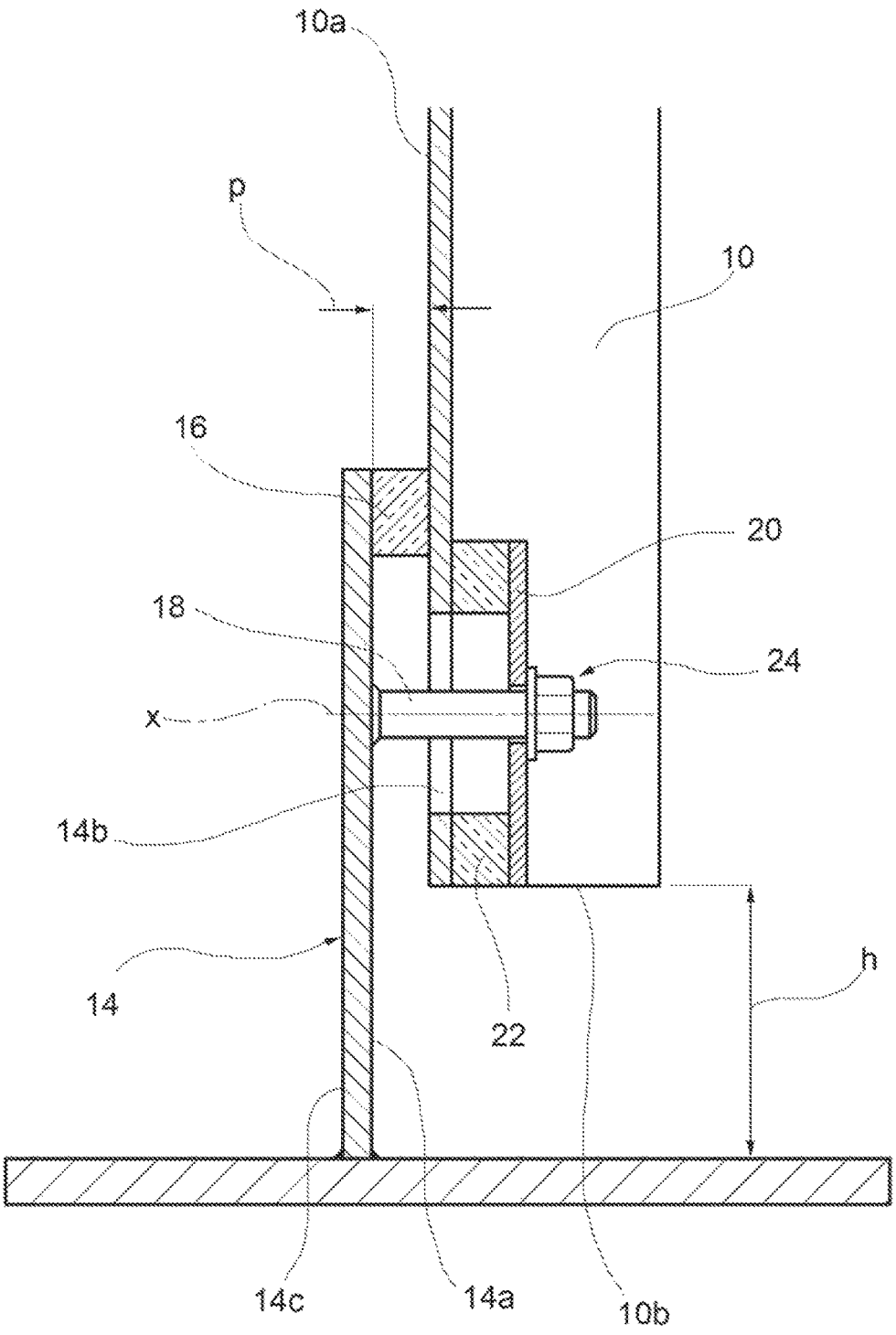
FIG. 8 is a diagrammatic cross-sectional view of a connection assembly, according to an embodiment of the invention.

Protrusion 14 or bulkhead 10 comprises one or more through holes 14*b*, obtained on the second face 14*a* of protrusion 14 (as seen for example in FIG. 6), or on the first face 10*a* of bulkhead 10 (as seen for example in FIG. 8). Such holes 14*b* axially receive at least one projecting element 18 which protrudes from the first face 10*a* of bulkhead 10 or from the second face 14*a* of protrusion 14 (as seen for example in FIG. 8). Such a projecting element may be a stud (in the case shown here, a cylindrical stud), for example a Nelson stud, or a cantilevered element of any type.

The projecting element 18 is configured so as to have a smaller diameter than the diameter of hole 14*b* in which it is received, since stud 18 must be free to oscillate radially inside of said hole 14*b*. Thereby, the floating connection assembly makes a flexible-type connection between the constraint element 11 and the bulkhead 10, due to the combined action of the flexible seal 16 (capable of deforming as a function of the relative displacement between the constraint element 11 and the bulkhead 10) and the profile of hole 14*b*, which conveniently forms an abutment for stud 18, in the event that the radial travel of the latter exceeds the dimensional tolerance admitted in the design of the constraint.

Figure 7:
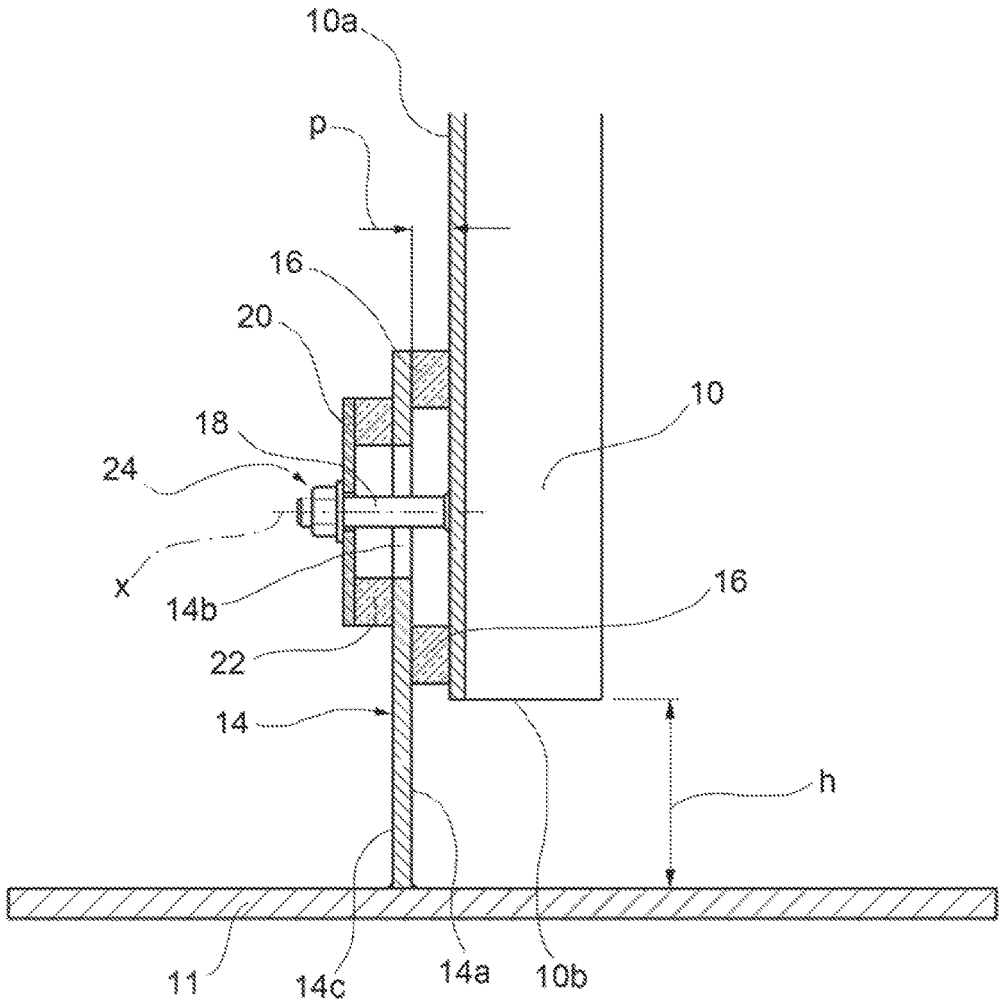
FIG. 7 is a diagrammatic cross-sectional view of the assembly in FIG. 5, according to an alternative embodiment.

According to an alternative embodiment (shown in FIG. 7), a pair of flexible seals or beads 16 made of sealing adhesive material can be spaced apart transversely, so as to extend on opposite sides of stud 18.

Therefore, bulkhead 10 will actually be decoupled from the constraint element 11, within the limits of the dimensional tolerance given by the difference between the diameter of stud 18 and the diameter of hole 14*b*.

The projecting element 18 has an axis x substantially normal on the second face of protrusion 14.

Figure 6:
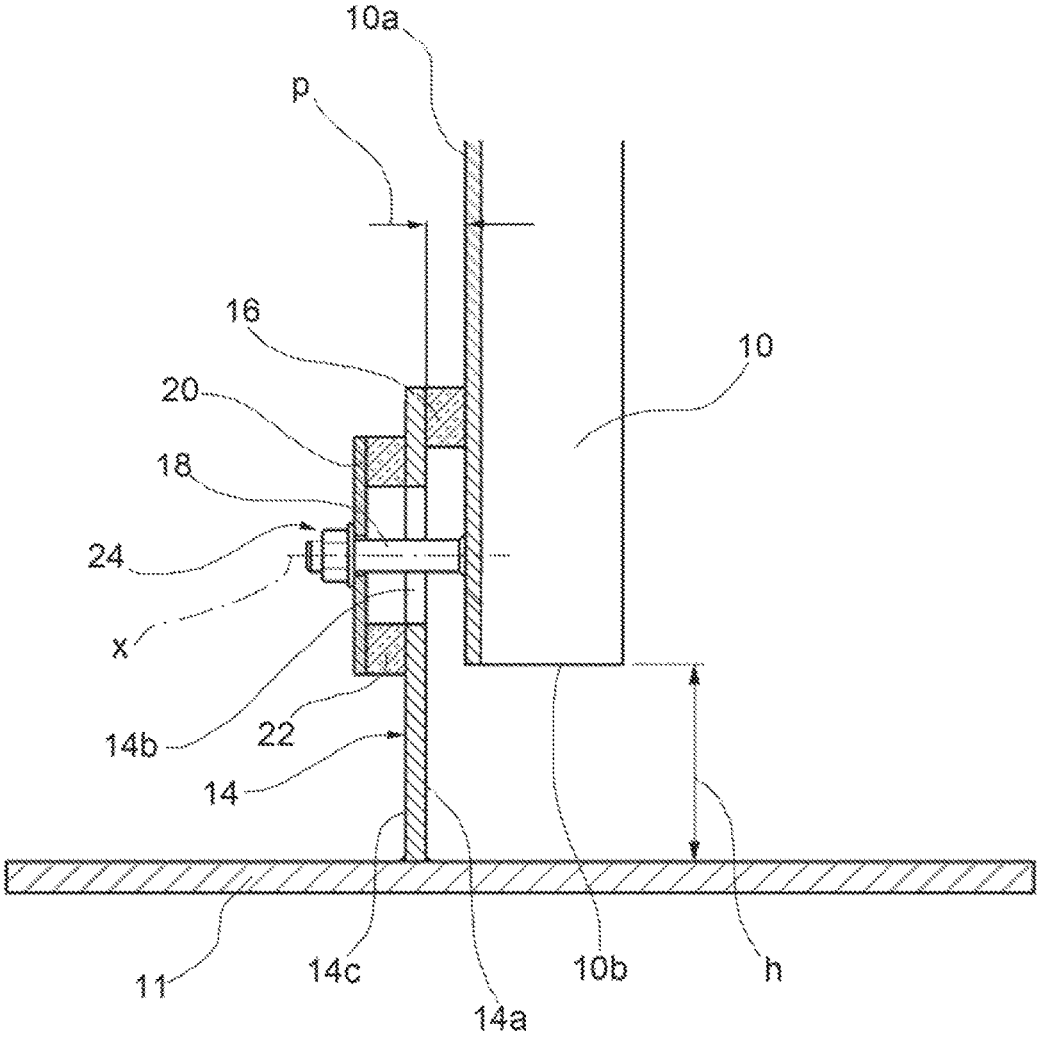
FIG. 6 is a diagrammatic cross-sectional view of the assembly in FIG. 5.

According to an embodiment of the invention, a closure plate 20 is placed parallel to protrusion 14; in the embodiment shown in FIG. 6, such a closure plate 20 faces the third face 14*c* of protrusion 14, so as to be transversely spaced apart therefrom, while in FIG. 8, for example, the closure plate 20 faces bulkhead 10.

Throughout the present description and in the claims, the terms and expressions indicating positions and orientations, such as "longitudinal", "transverse", "vertical" or "horizontal", shall be referred to the longitudinal edges 10*b*, 10*c* of the bulkhead.

The closure plate 20 is connected to protrusion 14 or to bulkhead 10 by means of a second peripheral seal 22, again flexible as in the case of the first seal 16.

The closure plate 20 is particularly suitable to constrain bulkhead 10 transversely to protrusion 14 or bulkhead 10, since it is made integral with the projecting element 18 (for example, by welding), or provides a backing surface for any retaining means 24, adapted to secure the projecting element 18 to the closure plate 20.

According to an embodiment of the present invention, the retaining means 24 may comprise a nut 24*a* which tightens the projecting element 18 against the outer surface of the closure plate 20, for example with the interposition of a washer 24*b*, with any anti-unscrewing system.

According to an alternative embodiment, bulkhead 10 comprises a plurality of modular panels 10', of variable shape and size. Such panels 10', configured as in FIG. 4 for example, are laterally juxtaposable to one another, thus forming the bulkhead 10.

According to an embodiment (not shown), the individual panels 10' may represent the constraint elements of the panels adjacent thereto, i.e. each panel may be constrained to the adjacent panel or panels, along one or both side edges 10*d*, by means of at least one floating connection assembly 12.

According to an embodiment, bulkhead 10 (or one or more panels 10' composing it) may be rigidly connected to a constraint element 11, for example an upper constraint element as in FIG. 4. Such a rigid connection can be made, for example, by welding, so as that bulkhead 10 or panel 10', at least along one edge, is conveniently supported in a rigid manner by a load-bearing structure of the ship or rigidly connected to an adjacent bulkhead or panel 10'.

The advantage achieved is that a solution for connecting the constructional elements of a ship or building is obtained, while preventing the stresses transmitted from one to another from resulting in a detriment to the structural stability or integrity of one of the connected elements.

Various aspects and embodiments of the floating connection assembly according to the invention have been described. It is understood that each embodiment may be combined with any other embodiment. Moreover, the invention is not limited to the embodiments described, but may be varied within the scope defined by the appended claims.

The invention claimed is:

1. A floating connection assembly of a bulk-head to at least one element of constraint, the bulkhead having a first face delimited by edges; said assembly comprising:

a protrusion integral to the element of constraint;

at least one first longitudinal sealing bead;

at least one projecting element projecting from the bulkhead or from the protrusion;

at least a second flexible seal; and at least one closure plate;

wherein:

the bulkhead and the coupling element are mutually separated by a separation distance along an edge of the bulkhead so that the bulkhead and the constraint element are connected only indirectly, by said floating assembly;

said protrusion has a second face and a third face parallel and opposite to each other, said second face being parallel and spaced apart with respect to the first face of the bulkhead;

the first longitudinal sealing bead is interposed between the first face of the bulkhead and the second face of the protrusion;

the protrusion or the bulkhead comprises at least one through hole on the second face of said protrusion or on the first face of the bulkhead;

the at least one closure plate is concentric with respect to said through hole, and parallel and spaced apart with respect to the third face of the protrusion or to the bulkhead;

the second flexible seal is interposed between the closure plate and the third face of the protrusion or between the closure plate and the bulkhead;

the at least one projecting element protrudes from the first face of the bulkhead or from the second face of said protrusion, is axially inserted in a respective through hole, and is integral with a respective closure plate, so that the bulkhead remains cantilevered on said protrusion, avoiding a different support; and the projecting element has a diameter smaller than a diameter of the respective hole, so that said projecting element is freely floatable inside the through hole in a radial direction.

2. A floating connection assembly according to claim 1, wherein:

the at least one projecting element projects from the bulkhead;

the protrusion comprises at least one through hole on the second face of said protrusion;

the second flexible seal is interposed between the closure plate and the third face of the protrusion; and the at least one projecting element protrudes from the first face of the bulkhead, is axially inserted in a respective through hole, and is integral with a respective closure plate, so that the bulkhead remains cantilevered on said protrusion, avoiding a different support.

3. An assembly according to claim 1, wherein the at least one longitudinal sealing bead is a first flexible seal, and the at least one longitudinal sealing bead further comprises at least one retainer, which engages the projecting element against the closure plate, so that said first and second flexible seals and said protrusion are axially tightened.

4. An assembly according to claim 3, wherein the retainer abuts against said closure plate.

5. An assembly according to claim 1, wherein the first longitudinal sealing bead is a longitudinal sealing bead of adhesive material which is silicone-based or polyurethane based or hybrid polymers-based or acrylic materials-based.

6. An assembly according to claim 1, wherein the bulkhead comprises a plurality of panels laterally juxtaposed.

7. An assembly according to claim 6, wherein each panel is connectable to at least one adjacent panel by said floating assembly.

8. An assembly according to claim 1, wherein the bulkhead is rigidly connected along at least one edge to at least one element of constraint.

9. An assembly according to claim 8, wherein the bulkhead is superiorly connected to the element of constraint by welding.

10. A boat, comprising a floating connection assembly according to claim 1.

11. A method for decoupling a bulkhead from at least one element of constraint to limit stresses exchanged between said bulkhead and said at least one element of constraint, said bulkhead comprising a first face delimited by edges, and said method comprising the steps of:

a) positioning the bulkhead at a separation distance from the element of constraint, so that the bulkhead and the element of constraint are separated along an edge of said bulkhead;

b) providing a protrusion, comprising a second face and providing at least one through hole, formed on said second face, or on the first face of the bulkhead;

c) securing the protrusion to the element of constraint, so that the second surface of said protrusion is parallel to the first surface of the bulkhead, and transversely spaced from said first surface;

d) applying at least one longitudinal sealing bead in a position interposed between the first face of the bulkhead and the second face of the protrusion;

e) securing at least one projecting element to the bulkhead, so that said projecting element protrudes transversely from the first face of the bulkhead and inserts axially in a respective hole of the protrusion or, vice-versa, so that said projecting element protrudes transversely from the second face of the protrusion and inserts axially in a respective hole of the bulkhead said projecting element being radially floatable inside the hole;

f) positioning a closure plate parallel to the protrusion and concentrically with respect to a respective through hole; and g) connecting said closure plate to the protrusion or the bulkhead by a second flexible peripheral seal, interposed between said closure plate and said protrusion or between said closure plate and said bulkhead so that the projecting element completely passes through the hole and is integral with the closure plate.

12. A method according to claim 11, comprising the steps of:

a) positioning the bulkhead at a separation distance from the element of constraint, so that the bulkhead and the element of constraint are separated along an edge of said bulkhead;

b) providing a protrusion, comprising a second face and at least one through hole, formed on said second face;

c) securing the protrusion to the element of constraint, so that the second surface of said protrusion is parallel to the first surface of the bulkhead and transversely spaced from said first surface;

d) applying at least one longitudinal sealing bead in a position interposed between the first face of the bulkhead and the second face of the protrusion;

e) securing at least one projecting element to the bulkhead, so that said projecting element protrudes transversely from the first face of the bulkhead and inserts axially in a respective hole of the protrusion, said projecting element being radially floatable inside the hole;

f) positioning a closure plate parallel to the protrusion and concentrically with respect to a respective through hole; and g) connecting said closure plate to the protrusion by a second flexible peripheral seal, interposed between said closure plate and said protrusion so that the projecting element completely passes through the hole and is integral with the closure plate.

13. A method according to claim 11, comprising the step of axially tightening the projecting element to the protrusion.

14. A method according to claim 13, wherein the tightening step is carried on by abutting a retainer, which engages the projecting element against said closure plate.

15. A method according to claim 11, wherein the first longitudinal sealing bead is a longitudinal sealing bead of adhesive material which is silicone-based or polyurethane based or hybrid polymers-based or acrylic materials-based.

16. A method according to claim 11, comprising the step of laterally juxtaposing a plurality of panels to form the bulkhead.

17. A method according to claim 16, comprising the step of connecting at least one pair of adjacent panels by the method according to claim 10.

18. A method according to claim 11, comprising the step of rigidly fixing the bulkhead to at least one element of constraint, along at least one edge of said bulkhead.

19. A method according to claim 18, wherein the step of fixing the bulkhead to the element of constraint is carried on by welding.

20. A method for decoupling a bulkhead from at least one element of constraint of a vessel, comprising the steps of claim 11.

* * * * *